United States Patent [19]

Bonus

[11] Patent Number: 4,530,556

[45] Date of Patent: Jul. 23, 1985

[54] ELECTRICAL SAFETY RECEPTACLE

[76] Inventor: Thomas G. Bonus, 7320 State Rd., Cleveland, Ohio 44134

[21] Appl. No.: 486,360

[22] Filed: Apr. 19, 1983

[51] Int. Cl.[3] ..... H01R 13/639

[52] U.S. Cl. ..... 339/75 P; 339/82

[58] Field of Search ..... 339/75 P, 82, 154 R, 339/154 A, 156 R, 157 R, 158, 159 R

[56] References Cited

U.S. PATENT DOCUMENTS

| | | | |
|---|---|---|---|
| 2,590,505 | 3/1952 | Carlsen | 339/75 P |
| 2,702,893 | 2/1955 | Paulson | 339/154 A |
| 2,704,831 | 3/1955 | Smith | 339/75 P |
| 2,732,531 | 1/1956 | Janowiec | 339/75 P |
| 2,799,009 | 7/1957 | Benander | 339/75 P |
| 3,131,013 | 4/1964 | Carlson | 339/159 |
| 3,714,616 | 1/1973 | Sample | 339/159 R |
| 3,891,289 | 6/1975 | Hanke | 339/14 P |
| 3,942,856 | 3/1976 | Mindheim et al. | 339/74 R |
| 4,085,991 | 4/1978 | Marshall et al. | 339/75 P |
| 4,136,919 | 1/1979 | Howard et al. | 339/75 P |

FOREIGN PATENT DOCUMENTS

| | | | |
|---|---|---|---|
| 1525963 | 4/1968 | France | 339/82 |

*Primary Examiner*—John McQuade

*Attorney, Agent, or Firm*—Kerkam, Stowell, Kondracki & Clarke

[57] ABSTRACT

An electrical safety receptacle is adapted to clamp the prongs of a plug within a socket such that children may not remove the plugs from the socket. The electrical safety receptacle fits into a normal wall outlet receptacle or over the receptacle. An arrangement of wedges is used to clamp the plug prongs in order to hold the plug in position.

17 Claims, 4 Drawing Figures

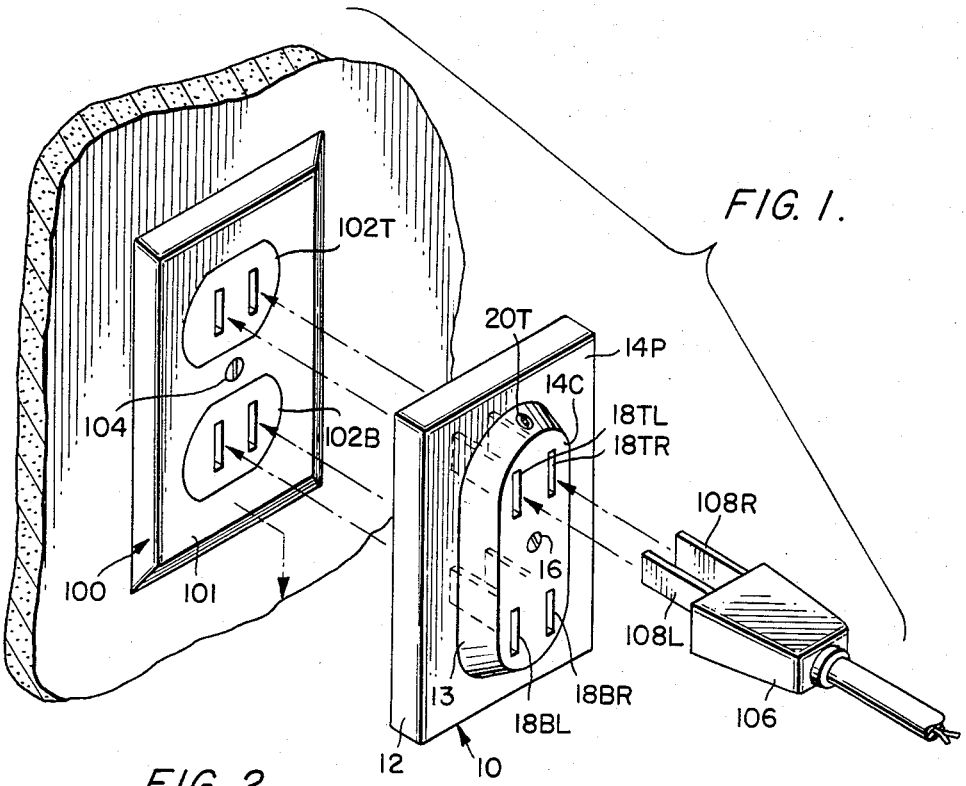
FIG. 1.
FIG. 2.
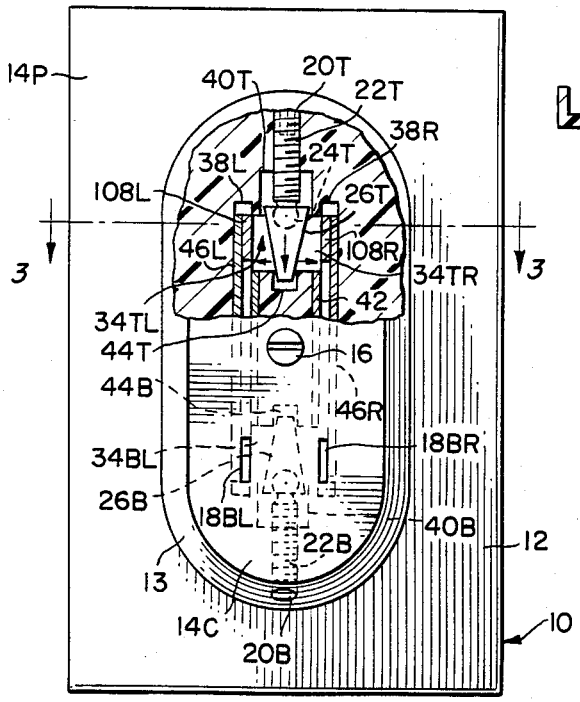
FIG. 3.
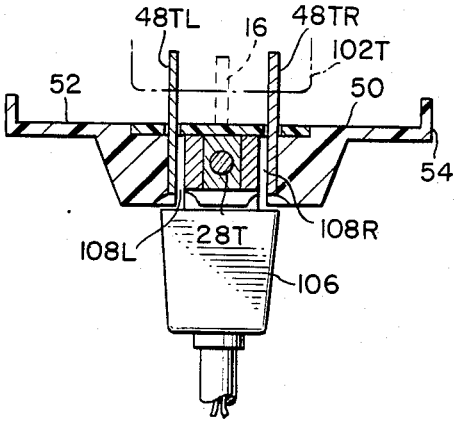

ELECTRICAL SAFETY RECEPTACLE

BACKGROUND OF THE INVENTION

1. Field of the Invention

This invention relates to an electrical safety receptacle. More specifically, this invention relates to an electrical safety receptacle which locks plugs into place within the receptacle.

2. Definitions

As used in this patent application and its claims, an "Electrical Receptacle" shall refer to any electrical outlet constructed to receive a standard A.C. electrical plug whether the outlet is wall mounted or comprising an extension or adapter. A standard electrical plug includes two prongs which may be of the same size or alternately slightly different sizes as, for example, in polarized plugs. A third prong for grounding purposes is also included in some standard electrical plugs which are used for heavy appliances.

3. Description of the Prior Art

It is well known that electrical outlets pose a safety hazard with respect to young children. Children who are not old enough to know better than to play with electricity often have the capability of removing a plug from an outlet and may insert paper clips or other objects into the electrical outlet socket. At the very least, such actions lead to electrical shocks. Tragically, children have been known to electrocute themselves when they have mimicked their parents actions by inserting metallic objects into electrical wall sockets or extension cord sockets.

In order to avoid or minimize the risk to children posed by electrical receptacles, numerous devices and techniques are known.

One common technique for minimizing possible injury to children is to place plastic safety caps over sockets which are not in use. Such safety caps include two plastic extending prongs which are similar in shape to the prongs on a regular plug and, which are received in the socket openings to thereby cover the socket which would otherwise be exposed. However, this is a partial solution, at best, because a child may still remove the plastic safety cap and then insert paper clips or other metallic objects into the prong receiving holes of the extension cord or wall socket. Likewise, the child may remove or partially remove a plug from one of the sockets and subject himself to the possibility of electric shock.

As a further step in trying to minimize electrical danger to children from wall or extension cord receptacles, the prior art includes devices adapted to lock the prongs of an electrical plug into a socket. Some of these devices have required that the prongs of the plug have a special construction. For example, such devices might require an extra notch in the construction of the plug. Obviously, if one has to use special plugs for each of ones' appliances, this will be undesirably expensive.

Several known forms of prior art safety receptacles are adapted to work with standard electrical plugs. However, standard electrical plugs include variations in design although the base design is the same and not all such plugs will work with all electrical receptacles. For example, standard electrical plugs may include holes adjacent the tips of the two prongs of the plug and the associated receptacle devices may include members which lock the plug into the receptacle by extending through such holes. However, a plug which does not include such holes in its prongs would therefore be ill suited for these types of safety receptacles.

Another known prior art receptacle construction uses locking members which push against one or more of the prongs of a plug to hold it in position within the electrical receptacle. However, such prior art devices are generally complex and expensive in construction. Further, such prior art devices tend to have problems associated with the unlocking mechanism. In order to remove a plug from the socket it is necessary to unlock the means which is being used to hold the plug into the socket. Unfortunately, those prior art devices, which are difficult enough to successfully withstand tampering by children, are often inconvenient or difficult for adults to operate, particularly senior citizens and those suffering from arthritis. Conversely, those prior art devices, which facilitate easy removal of the plug by an adult manipulating a lever or something similar, are often simple enough for children to operate.

OBJECTS AND SUMMARY OF THE INVENTION

Accordingly, it is a primary object of the present invention to provide a new and improved electrical safety receptacle.

A further object of the present invention is to provide an improved electrical safety receptacle which will operate with all common variations of standard electrical plugs.

A further object of the present invention is to provide an electrical safety receptacle which is virtually immune to tampering by young children.

A still further object of the present invention is to provide an electrical safety receptacle which is easily operable by adults.

Another object of the present invention is to provide an electrical safety receptacle which is relatively simple and inexpensive in construction.

Yet another object of the present invention is to provide an electrical safety receptacle which will fit over a normal electrical wall outlet without requiring any permanent modifications to the wall outlet.

A still further object of the present invention is to provide an electrical safety receptacle which is sufficiently thin as to adapt to normal wall outlets without being conspicuous, and when in place, will replace the normal plate that covers the receptacle.

The above and other objects of the present invention, which will be apparent as the description proceeds, are realized by an electrical safety receptacle comprising: a housing including a front cover, at least a first electrical plug receiving assembly including: a pair of electrically isolated contact portions mounted in the housing, each contact portion being electrically connected to at least one corresponding backwardly extending prong insertable in an electrical socket to electrically energize the safety receptacle, each contact portion operable for electrically contacting a plug prong inserted into one of a pair of prong-receiving slots in the front cover, a lock actuator recessed in the housing and movable between a normal position and a locking position, the lock actuator being actuable to change from the locking position to the normal position only by use of a tool, and locking means operable to secure a prong inserted in each of the prong receiving slots when actuated by movement of the lock actuator from the normal position to the locking position. The safety receptacle further comprises a second electrical plug receiving assembly constructed identically to the first electrical plug receiving assembly. The locking means comprises two separate locking-elements, each locking elements operable to secure a prong inserted in one of the prong receiving slots. The lock actuator includes a actuating wedge. Each of the locking elements is a wedge and the lock actuator includes a recessed screw operable to cause translation movement of the actuating wedge which in turn spreads the locking wedges to clamp plug prongs in the prong receiving slots. The housing comprises a relatively thin peripheral portion and a relatively thick central portion, with each of the first and second plug receiving assemblies being disposed in the relatively thick central portion.

The present invention may alternately be recited as an electrical receptacle comprising: a housing having a front cover, at least a first electrical plug receiving assembly comprising a pair of contacts mounted in the housing, each contact operable for electrically contacting a prong of an electrical plug inserted into a corresponding one of a pair of prong receiving slots in the front cover, a lock actuator in the housing including an actuator wedge, the actuating wedge being movable between a normal position and a locking position, and at least a first locking wedge operable to secure at least one prong in one of the prong receiving slots when actuated by movement of the actuating wedge from the normal position to the locking position.

The present invention may alternately be described as an electrical receptacle comprising: a housing including a front cover, at least a first electrical plug receiving assembly comprising a pair of contacts mounted in the housing, each contact operable for electrically contacting a prong inserted into a corresponding one of a pair of prong receiving slots in the front cover, a lock actuator in the housing and movable between a normal position and a locking position, and a pair of locking elements in the housing, each locking element being operable to secure a prong in one of the prong receiving slots when actuated by movement of the lock actuator from the normal position to the locking position. Movement of the lock actuator in one direction causes a perpendicular movement of each of the locking elements. Each of the locking elements is a locking wedge operable to clampingly secure one prong in one of the prong receiving slots. The safety device contains four locking wedges. There are two for each receptacle. When an electric plug is inserted into one of the receptacles, both of its prongs are securely locked into place by the two locking wedges of that receptacle.

BRIEF DESCRIPTION OF THE DRAWINGS

The above and other features of the present invention will be more readily understood when the following detail description is considered in conjunction with the accompanying drawings wherein like characters represent like part throughout the several views and in which:

FIG. 1 shows a perspective view of the present invention in conjunction with a normal wall outlet and a standard electrical plug.

FIG. 2 shows a plane front view of the present invention with several parts broken away for illustrative purposes.

FIG. 3 shows a cross section view taken along lines 3—3 of FIG. 2.

DETAILED DESCRIPTION OF THE PREFERRED EMBODIMENTS

Figure 4:
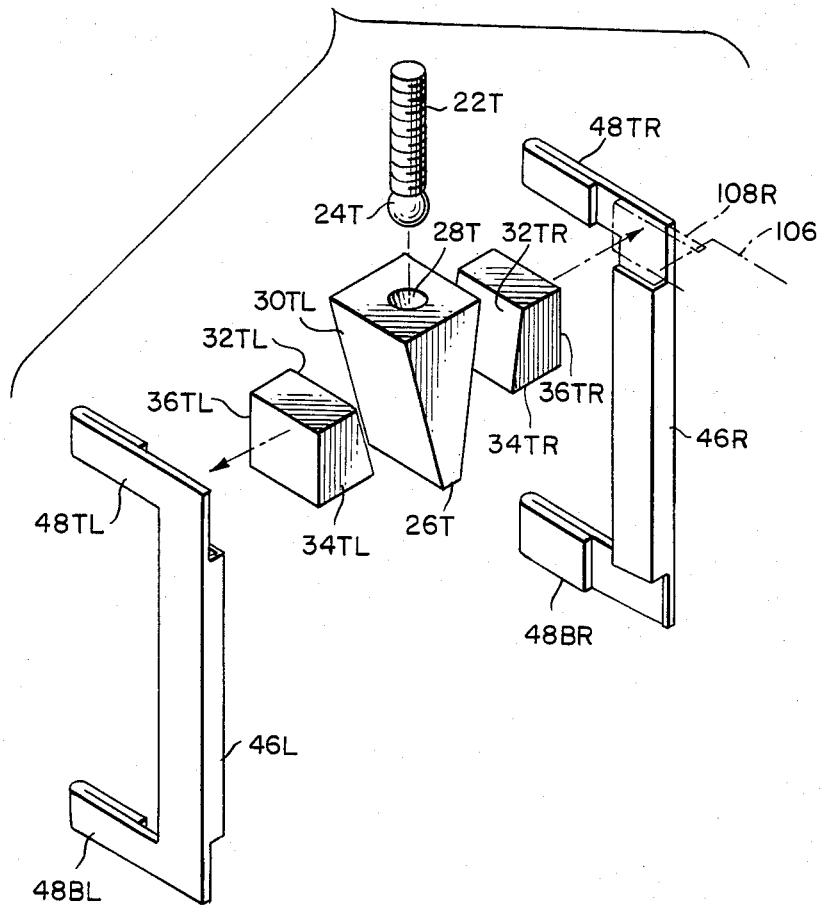
FIG. 4 shows a perspective exploded view of several parts of the present invention.

Turning now to FIG. 1, there is shown a perspective view of an electrical safety receptacle 10 according to the present invention and a conventional wall outlet 100 and a standard electrical plug 106. The safety receptacle 10, wall outlet 100, and plug 106 are shown spaced apart and are positioned to indicate how they fit together. As shown, the electrical safety receptacle 10 of the present invention is adapted to fit over the normal electrical outlet receptacle 100 and accept a standard electrical plug 106.

The conventional wall outlet 100 includes a cover plate 101 and top and bottom outlets 102T and 102B respectively. A screw 104 holds the cover plate 101 in place. The conventional household plug 106 includes a right (first) prong 108R and a left (second) prong 108L.

Continuing to consider the perspective view of FIG. 1, but also considering the plane front view of FIG. 2, the cross section view of FIG. 3 and the exploded view of FIG. 4, the details of construction of the electrical safety receptacle 10 will be discussed. In particular, the electrical safety receptacle 10 includes a front cover 12 seving as a housing. The front cover 12 includes a peripheral thin portion 14P and central thick portion 14C. At the center of the thick portion 14C is a screw 16 which extends through to the back of the device 10. The thick portion 14C includes a pair of prong receiving slots, top right slot 18TR and top left slot 18TL. The central thick portion 14C of the front cover 12 further includes bottom right prong receiving slot 18BR and bottom left prong receiving slot 18BL.

The surface 13 extends around the thick portion 14C and separates it from the relatively thin portion 14P. The surface 13 of the front cover 12 further includes a top hole 20T and bottom hole 20B.

The top half and bottom half of the electrical safety receptacle 10 are mirror images of each other. Because the top half and bottom half of the electrically safety receptacle 10 are constructed identically, the present description will concentrate on the top half. Those parts in the top half will be labeled with a T following their numerical reference number, whereas the corresponding parts of the bottom half will be labeled with a B following their numeral.

Recessed within the top hole 20T, is a screw 22T which may be of the "allen" type. As best shown in FIGS. 2 and 4, the screw 22T includes a ball 24T at its end remote from the entrance to the hole 20T. The screw 22T is attached to an actuating wedge 26T by snapping the ball 24T into a hole 28T. The hole 28T is narrower at its mouth such that the ball 24T will remain seated therein while allowing the allen screw 22T to turn relative to the wedge 26T. The wedge 26T includes right and left actuating wedge surfaces. The surfaces respectively abut locking wedge surfaces 32TR and 32TL on locking wedges 34TR and 34TL respectively. The locking wedges 34TR and 34TL have respective clamping surfaces 36TR and 36TL remote from the actuating wedge 26T.

Referring to FIG. 2, the central thick portion 14C of front cover 12 is generally solid but includes right and left contact strip cavities 38R and 38L and top and bottom cavities 40T and 40B. The screws 22T and 22B extend from their respective holes 20T and 20B into the respective top and bottom cavities 40T and 40B. The cavities 40T and 40B extend between the right and left contact strip cavities 38R and 38L. A land 42, which is preferably integral with the front cover 12, is in between the cavities 38R and 38L and cavities 40T and 40B. The land 42 includes a top notch 44T and a bottom notch 44B.

Disposed within the right and left contact strip cavities 38R and 38L are respective right and left contact strips 46R and 46L. Top right backwardly extending prong 48TR, bottom right backwardly extending prong 48BR, top left backwardly extending prong 48TL, and bottom left backwardly extending prong 48L are integral with a corresponding one of the contact strips 46R and 46L as best shown in FIG. 4.

As best shown in FIG. 3, a back cover 50 is recessed to be flush with the back surface 52 of cover 12. A peripherally extending flange 54 extends completely around the front cover 12.

The mounting of the present invention to an existing wall outlet will now be discussed with particular reference to FIG. 1. First, the screw 104 in the wall outlet 100 is removed. Then, the cover plate 101 is removed and the backwardly extending prongs 48TR, 48BR, 48TL, and 48BL, are inserted into the prong receiving holes in the sockets 102A and 102B. The screw 16 in the electrical safety receptacle 10 is then screwed into the hole from which the screw 104 has been removed. The cover plate 101 should be removed prior to attachment of the present electrical safety receptacle 10, but one could alternatively leave it in place as shown in FIG. 3.

Once the device 10 has been mounted on the home wall outlet 100, a standard electrical plug such as plug 106 may be inserted with its prongs 108R and 108L extending into the prong receiving holes 18TR and 18TL. When the plug 106 is inserted in this fashion, it may readily be locked in place by the present invention. Specifically, and as best visualized by considering FIGS. 2 and 4, the allen head screw 22T is rotated by an allen head screw driver in order to move the screw 22T and actuating wedge 26T from an upper normal position into a lower locking position. In other words, the screw 22T is moved deeper into the threaded hole 20T. Although rotation of the allen screw 22T and its associated ball 24T does not rotate the actuating wedge 26T it will push the actuating wedge downwardly in translational movement into the top notch 44T. The downward movement of the wedge 26T will in turn cause the spreading the locking wedges 34TR and 34TL. As these locking wedges spread, their clamping surfaces 36TR and 36TL will respectively clamp the prongs 108R and 108L against contact portions of the right and left contact strips 46R and 46L. When the allen screw 22T is sufficiently deep within the threaded hole 20T, the locking wedges 34TR and 34TL will prevent removal of the plug 106.

As will be readily apparent, an adult with an allen wrench may loosen the screw 22T such that the actuating wedge 26T is moved upwardly. Wedges 34TR and 34TL will not be drawn together by this upward movement of wedge 26T, but their gripping or clamping against the prongs 108R and 108L will cease once the wedge 26T is moved sufficiently upward. The prongs 108R and 108L may then be readily removed from the prong receiving slots 18TR and 18TL.

The lock actuator screw 22T with its ball portion 24T, actuating wedge 26T, locking wedges 34TR and 34TL, backwardly extending prongs 48TR and 48TL together with the upper contact portions of contact strips 46R and 46L may together considered as an electrical plug receiving assembly, whereas the bottom allen screw 22B and its associated components may be considered as a second electrical plug receiving assembly.

When the present electrical safety receptacle 10 is placed in a wall unit, a plastic cap (not shown) may be used to plug up empty prong receiving slots such as 18TR and 18TL. Since such plastic caps, which are well known in the art, include two plastic prongs similar in shape and size to the prongs 108R and 108L of plug 106, the plastic prongs may be clamped or locked into position in the same fashion as locking elements or wedges 34TR and 34TL lock the prongs 108R and 108L into position.

The front cover 12, screws 22T and 22B, wedges 26T, 26B, 34TR, 34BR, 34TL, and 34BL, should be made of a nonconductive material. For example, the screws 22T and 22B may be nylon screws, whereas the other mentioned parts are preferably made of plastic. The contact strips 46R and 46L and their associated backward extending prongs are, of course, made of conductive materal such as copper.

Although a specific embodiment has been shown herein, modifications and adaptations will be readily aparent those of ordinary skill in the art. For example, although the preferred embodiment shows an adaptor which fits into a normal wall outlet, numerous of the inventive concepts presented herein are also applicable to a device permanently affixed to a wall as an outlet. Further, numerous of the inventive concepts presented herein are applicable to receptacles such as sockets or female electrical connectors on extension cords. Accordingly, the scope of the present invention should best be determined by reference to the claims appended hereto.

What is claimed is:

1. An electrical safety receptacle comprising:

(a) a housing, (b) at least a first electrical plug receiving assembly comprising:

(i) a pair of electrically isolated contact portions mounted to said housing, each contact portion electrically connected to at least one corresponding backwardly extending prong insertable in an electrical socket to electrically energize said safety receptacle, each contact portion being operable for electrically contacting a plug prong inserted into one of a pair of prong-receiving slots in a front cover, (ii) a lock actuator comprising an actuating wedge recessed in said housing and movable between a normal position and a locking position, said lock actuator actuable to change from said locking position to said normal position only by use of a tool, and (iii) locking means operable to secure a prong in each of said prong-receiving slots when actuated by movement of said lock actuator from said normal position to said locking position, said locking means comprising two separate locking wedge locking elements each said wedge locking element being operable to secure a prong in one of said prong receiving slots, and (iv) said lock actuator including a recessed screw operable to cause translation movement of said actuating wedge which in turn spreads said locking wedges to clamp plug prongs in said prong-receiving slots.

2. The electrical safety receptacle of claim 1 further comprising a second electrical plug receiving assembly constructed identically to said first electrical plug receiving assembly, said housing comprising a relatively thin peripheral portion and a relatively thick central portion, each of said first and second plug receiving assemblies disposed in said relatively thick central portion.

3. An electrical safety receptacle comprising:

(a) a housing, and (b) at least a first electrical plug receiving assembly including:

(i) a pair of contacts mounted in said housing, each contact operable for electrically contacting a prong of an electrical plug inserted into a corresponding one of a pair of prong-receiving slots in a front cover, (ii) a lock actuator in said housing and including an actuating wedge, said actuating wedge movable between a normal position and a locking position, and (ii) a first locking wedge operable to secure a first prong of said plug in a first of said prong-receiving slots when actuated by movement of said actuating wedge from said normal position to said locking position, and (iv) a second locking wedge operable to secure a second prong in a second of said prong-receiving slots when actuated by movement of said actuating wedge from said normal position to said locking position.

4. The electrical safety receptacle of claim 3 further comprising a second electrical plug receiving assembly constructed identically to said first electrical plug receiving assembly.

5. The electrical safety receptacle of claim 3 wherein said lock actuator is actuable to change from said locking position to said normal position only by use of a tool.

6. The electrical safety receptacle of claim 3 wherein each of said pair of contacts is electrically connected to at least one corresponding backwardly extending prong insertable in an electrical socket to electrically energize said safety receptacle.

7. The electrical safety receptacle of claim 6 further comprising a second electrical plug receiving assembly constructed identically to said first electrical plug assembly, said housing comprising a relatively thin peripheral portion and a relatively thick central portion, each of said first and second plug receiving assemblies disposed in said relatively thick central portion.

8. An electrical safety receptacle comprising:

(a) a housing (b) at least a first electrical plug receiving assembly comprising:

a pair of electrically isolated contact portions mounted to said housing, each contact portion electrically connected to at least one corresponding backwardly extending prong inserted in an electrical socket to electrically energize said safety receptacle, each contact portion being operable for electrically contacting a plug prong inserted into one of a pair of prong-receiving slots in a front cover, a lock actuator recessed in said housing and movable between a normal position and a locking position, locking means operable to secure each prong in the associated prong-receiving slots when actuated by movement of said lock actuator from said normal position to said locking position, said locking means comprising a first and a second locking wedge element, each operable to secure a prong in an associated prong-receiving slot, said lock actuator comprising an actuating wedge disposed for movement between said first and second elements whereby upon movement of said actuating wedge to the locking position said first and second wedge elements are engaged and caused to secure the associated prong elements in the associated prong-receiving slots.

9. The electrical safety receptacle of claim 8 further comprising a second electrical plug receiving assembly constructed identically to said first electrical plug receiving assembly.

10. The electrical safety receptacle of claim 8 wherein said lock actuator includes a recessed screw operable to cause translation movement of said actuating wedge which in turn laterally spreads said locking wedges to clamp plug prongs in said prong-receiving slots.

11. The electrical safety receptacle of claim 8 further comprising a second electrical plug receiving assembly constructed identically to said first electrical plug receiving assembly, said housing comprising a relatively thin peripheral portion and a relatively thick central portion, each of said first and second plug receiving assemblies disposed in said relatively thick central portion.

12. An electrical safety receptacle comprising:

(a) a housing including (b) at least a first electrical plug receiving assembly including:

(i) a pair of contacts mounted in said housing, each contact operable for electrically contacting a prong inserted into a corresponding one of a pair of prong-receiving slots in a front cover, (ii) a lock actuator in said housing and rectilinearly movable between a normal position and a locking position, and (iii) a pair of separate wedge locking elements in said housing, each locking element operable to secure a prong in one of said prong-receiving slots when actuated by movement of said lock actuator from said normal position to said locking position, said lock actuator comprising a wedge disposed for movement in one direction between said pair of locking elements so as to cause a movement of each of said locking elements normal to that of said actuator and thereby cause said locking elements to wedge against and lock the prongs in their associated prong-receiving slots.

13. The electrical safety receptacle of claim 12 wherein said lock actuator is actuable to change from said locking position to said normal position only by use of a tool.

14. The electrical safety receptacle of claim 12 wherein each of said pair of contacts is electrically connected to at least one corresponding backwardly extending prong insertable in an electrical socket to electrically energize said safety receptacle.

15. The electrical safety receptacle of claim 12 further comprising a second electrical plug receiving assembly constructed identically to said first electrical plug receiving assembly.

16. The electrical safety receptacle of claim 12 wherein said housing comprising a relatively thin peripheral portion and a relatively thick central portion, and a first and a second electrical plug receiving assembly disposed in said relatively thick central portion.

17. The electrical safety receptacle of claim 12 wherein said lock actuator includes rotational means adapted for rotation from a position external of said housing to cause translational movement of said wedge of said lock actuator.

* * * * *